United States Patent [19]

Seckinger et al.

[11] Patent Number: 4,730,471

[45] Date of Patent: Mar. 15, 1988

[54] APPARATUS FOR ELECTROMAGNETIC LOCKING ON A LOCK CYLINDER FOR A MECHANICAL/ELECTRONIC LOCKING SYSTEM

[75] Inventors: Erich Seckinger, Wallisellen; Arno Kleinhäny, Hinwil, both of Switzerland

[73] Assignee: Bauer Kaba AG, Wetzikon, Switzerland

[21] Appl. No.: 921,200

[22] Filed: Oct. 21, 1986

[51] Int. Cl.[4] ..... E05B 47/00

[52] U.S. Cl. ..... 70/277; 70/380; 70/372

[58] Field of Search ..... 70/277–283, 70/379–380, 421, 372, DIG. 62; 292/359; 200/43.05

[56] References Cited

U.S. PATENT DOCUMENTS

| | | | |
|---|---|---|---|
| 2,475,220 | 7/1949 | Chaulk et al. | 171/97 |
| 3,599,454 | 8/1971 | Hill et al. | 70/265 |
| 3,748,878 | 7/1973 | Balzano et al. | 70/218 |
| 3,939,679 | 2/1976 | Barker et al. | 70/277 |
| 4,326,125 | 4/1982 | Flies | 70/277 |
| 4,393,672 | 7/1983 | Gelhard | 70/277 |
| 4,603,564 | 8/1986 | Kleinhany et al. | 70/277 |
| 4,658,105 | 4/1987 | Seckinger | 200/43.05 |

FOREIGN PATENT DOCUMENTS

| | | |
|---|---|---|
| 0110835 | 11/1983 | European Pat. Off. . |
| 2325566 | 12/1974 | Fed. Rep. of Germany . |
| 2428130 | 1/1980 | France . |
| 2024922 | 1/1980 | United Kingdom . |

*Primary Examiner*—Robert L. Wolfe
*Attorney, Agent, or Firm*—Walter C. Farley

[57] ABSTRACT

The electromagnetic locking apparatus functions on a lock cylinder with a rotor, to whose end is fitted in rotation-restrained manner a driver and a stator surrounding the rotor. It is positioned with respect to the lock cylinder and a control part engageable with the apparatus. The apparatus is characterized in that the locking means (20, 28) have an electromagnet part (20) with a two-part tie rod (401/402) with a return spring (45) acting on one tie rod part and a probe (28) connected to the other tie rod part (402).

7 Claims, 12 Drawing Figures

APPARATUS FOR ELECTROMAGNETIC LOCKING ON A LOCK CYLINDER FOR A MECHANICAL/ELECTRONIC LOCKING SYSTEM

The present invention is in the field of security technology and relates to an apparatus for electromagnetic locking of a lock cylinder for use in mechanical/electronic locking systems.

BACKGROUND OF THE INVENTION

Electronic-locking systems typically incorporate a lock cylinder according to the prior art (e.g. Swiss patent application No. 6903/82, published as EP-A-0110835) with means for blocking or allowing the relative movement between rotor and stator.

SUMMARY OF THE INVENTION

An object of the present invention is to so further develop an electromagnetic locking system that it provides improved security with respect to the opening/-closing function, in the case of operating failures, such as power failures and the like or when safety or security elements fail, as well as in the case of attempted forced entry.

In a lock cylinder to be locked electromagnetically, according to the invention the rotor is released either by the mechanical key associated therewith and/or by the electromagnetic locking system according to the invention.

An electromagnetically lockable lock cylinder has the advantage that it can be released via electromagnetic means, e.g. electronically, time-controlled, programmed, etc. A key belonging to the lock cylinder can then have electronic and mechanical or solely mechanical opening means. The electromagnetic locking system can also be released, e.g. in a remotely controlled manner, independently of the key.

BRIEF DESCRIPTION OF THE DRAWINGS

The invention is described in greater detail hereinafter relative to a non-limitative embodiment and the attached drawings, wherein:

FIGS. 4 and 4A to 4C are developed, plan and side elevations of one example of a sliding link in the form of a ring for the engagement of the scanning part;

DESCRIPTION OF THE PREFERRED EMBODIMENTS

Figure 1:
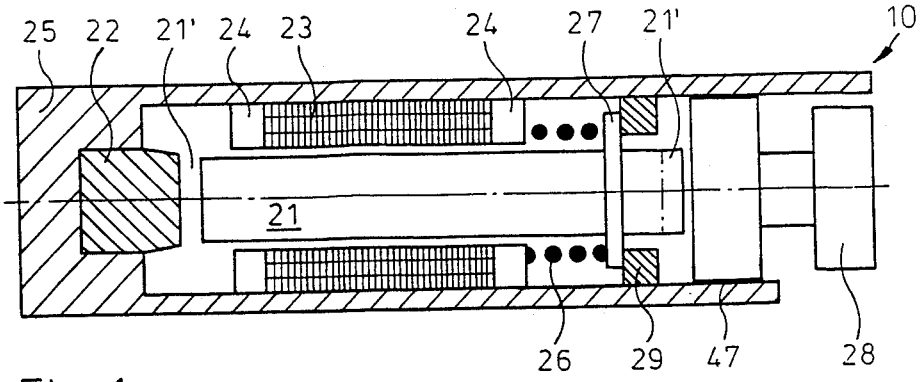
Fig. 1 PRIOR ART
FIG. 1 is an example of an electromagnetic locking means according to the prior art.

FIG. 1 shows an electromagnetic locking means 10 according to the prior art, which can be used for electromagnetic locking on a lock cylinder. It is possible to see a cylindrical housing 25, which encloses the electrical and mechanical locking parts. A bobbin 24 carrying the magnet coil 23 is inserted and fixed into the cylindrical lock housing. The armature 21 passing through the inner portion of coil 23 carries at one end a retaining ring 27, which is sufficiently large to act as a longitudinal movement limiter against the stop 29 located on the housing end. A compression spring 26 acting between bobbin 24 and retaining ring 27 in the form of a return spring brings the armature 21 into a clearly defined position with respect to the housing 25 and also with respect to a sliding link fixed on the rotor end of the lock cylinder. The magnetic field produced by the excited winding draws the armature 21 against the tension of compression spring 26 up to the armature stop 22 and simultaneously a clearance 21' is provided in the longitudinal direction for a probe **28*a*** engaging on the armature, so that the clearance obtained permits link play.

Figure 2:
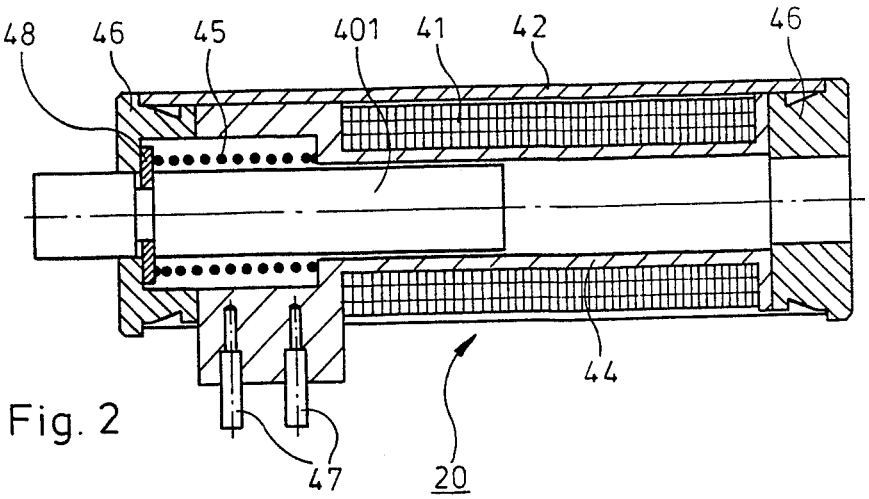
FIGS. 2 and 3 are schematic side elevations in longitudinal section the electromagnetic locking means according to the invention broken down into an electromagnetic base part and a scanning part.
Figure 3:
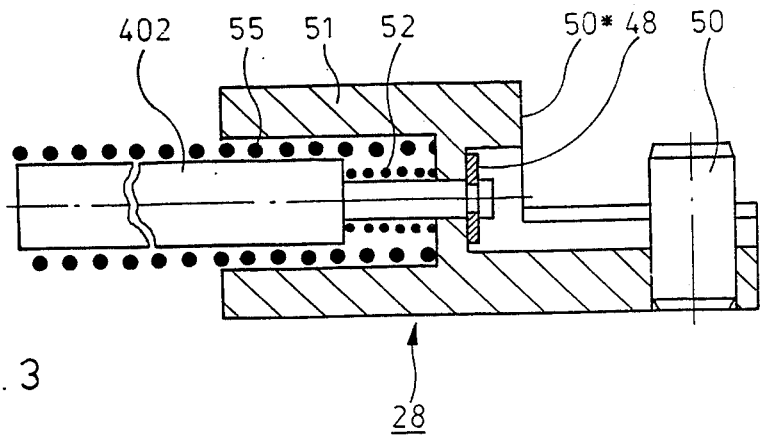
Figure 4:
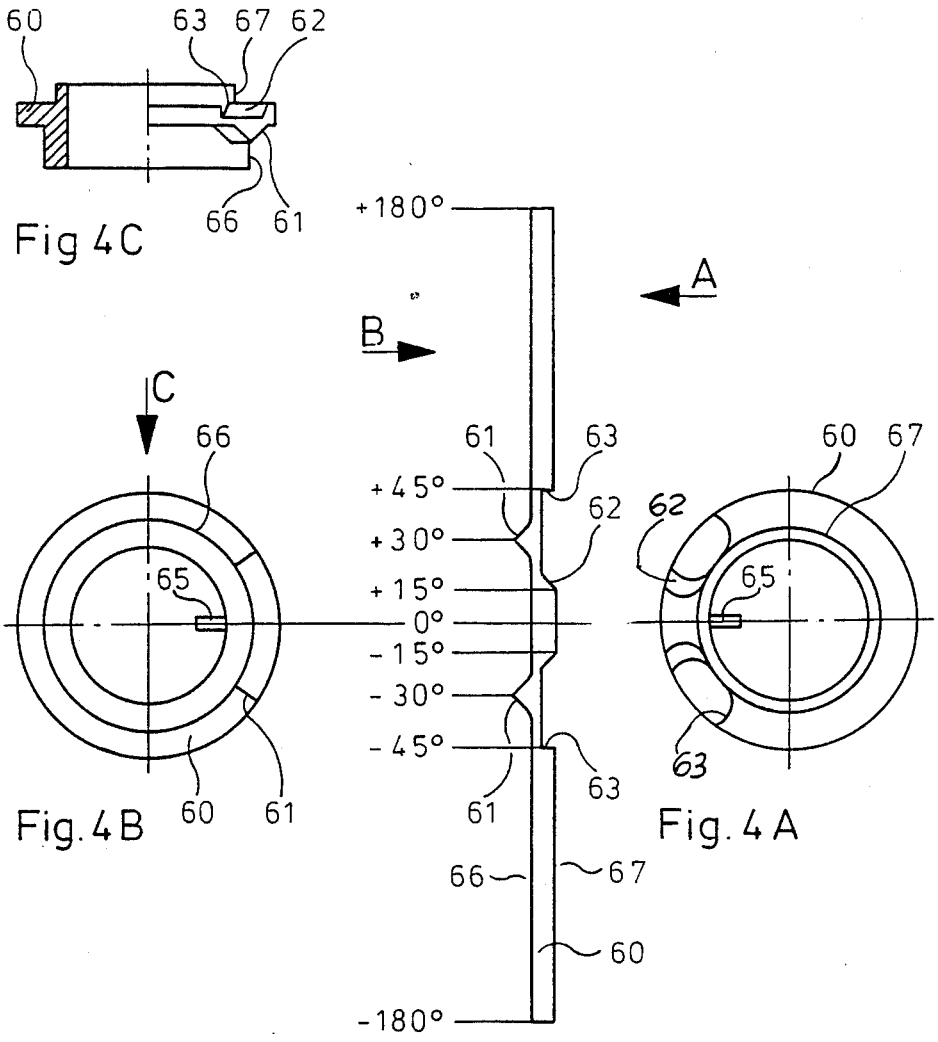

FIGS. 2 and 3 show a special embodiment of an electromagnetic locking apparatus 20, 28 cooperates with a hereinafter described control link 60 (FIGS. 4, 4A, 4B, 4C). An electromagnet part 20 with an exciting winding 41 and a special two-part, prestressed tie rod 401, 402 acts on a scanning part 28, into which is integrated one part 402 of the two-part tie rod. In this case, scanning part 28 has a sliding pin 50 and a sliding flank 50*, which are moved along an aforementioned control or sliding link 60. In the represented embodiment, this is an annular part, which is e.g. fixed to the lock cylinder rotor. FIGS. 4 to 4C show the example of a completely constructed control link, as used in preferred manner in conjunction with the invention and whose operation will be described hereinafter.

In detail, FIGS. 2 and 3 show the electromagnetic locking means. FIG. 2 shows the electrical base part 20 with exciting coil 41 and tie rod part 401, whilst FIG. 3 shows the scanning part 28 with sliding pin 50 and sliding flank 50*, as well as the other tie rod part 402. The breaking down of the tie rod into two parts has the following special aspects. There is to be a reciprocal dominance interaction between the control link and an electric exciting pulse, i.e. in the presence of an exciting voltage and prior to turning about a given rotation angle, the two tie rod parts 401 and 402 magnetically stick together. On exceeding this angle, magnetic bonding is prevented by the link as a result of the air gap formed.

To permit working in an electronic low-power, but safety-conscious manner, on attracting the magnet, the magnetic flux must be at a maximum. At the instant at which the voltage is to bring about a holding together of the tie rod, the air gap must consequently be zero. This is guaranteed by a tolerance compensation spring 52, a compression spring between the probe body 51 and the tie rod part 402 placed on the front end the tie rod being displaceably secured by means of a retaining ring 48 against the spring action on probe body 51, the spring 52 also being slightly prestressed. Tolerances in the link of control part 37 can lead to the probe body 51 being moved out of its air gap equal to zero position, e.g. with sliding flank 50* pressed in the direction of the tie rod or with the sliding pin 50 drawn in the opposite direction. As a function of the manufacturing tolerance of the components, this compression/tension is taken up by the tolerance compensating spring, without any change to the air gap equal to zero condition. In the case of an additional biasing of said spring during engagement in the sliding link, the manufacturing tolerances of the link are compensated in movement-wise manner. In addition, the pressure acting on the tie rod parts prevents zero clearance changes in the case of intentional or unintentional vibration to the lock cylinder, which greatly increases operational reliability.

FIG. 2 shows the exciter part of the electromagnet with a bobbin 44 and an exciting coil 41 wound on to the same, with one part 401 of the tie rod 401/402 and with a compression spring 45 as the return spring. A retaining ring 48 is located in a slot of the tie rod and absorbs the tension of the return spring. The coil is surrounded by a cylindrical housing 42, a recess being provided for electrical connections 47. For the desired operation with minimum energy requirements, the exciter part must be closed by covers 46, which serve to close the magnetic circuit and, as shown, simultaneously support the retaining ring. Scanning part 28 already discussed in connection with FIG. 3 is inserted in the exciter part at the time of assembly (cf. also FIGS. 5A, B, C). Between the electromagnet part 20 and the scanning part 28 is provided a third compression spring in the form of a retaining spring 55. The probe of scanning part 28, which is in this case realized by a sliding pin 50 and a sliding flank 50* on a probe body 51, engages with a control part which in the present embodiment, is in the form of an annular sliding link 60 drawn on to or applied to the circumference of the stator, if the latter is rotatable, or otherwise on to the circumference of the lock cylinder rotor. This probe 50, can engage the web-like sliding link 60 (or in another embodiment by means of a scanning pin in a correspondingly constructed sliding groove) and is controlled by control elements, such as cams and depressions shaped into the sliding link. In this case, the sliding link 60 has retaining flanks 63, on which can be engaged the sliding flank 50*, i.e. a rotation of the driver acting on the lock by an angle permitting the opening or closing of the latter is dependent on the position of the sliding flank 50* with respect to the retaining flank 63. The desired closing/opening function can be brought about by the mechanical release of the key (tumblers) or by the electromagnetic release through the locking means. A series connection of mechanical and electromagnetic locking is also possible.

FIGS. 4 and 4A to 4C show the annular embodiment of the control part in three viewing directions, as well as a development of the associated control link 60. The neutral or inoperative position of the cylinder prior to the opening or closing on the link is 0°. A rotation in direction +180° e.g. brings about a closing of the lock and rotation in the direction −180° an opening of the lock. Both functions are equivalent, so that the link is symmetrical with respect to zero. If the pull magnet is deenergized, the scanning part 28 is forced against the link wall shown on the right hand side A in the drawing due to the tension of springs 52 and 55, i.e. the tolerance compensating spring and a retaining spring. After about 15°, a rotation of the control link brings about a successive separation of the two tie rod parts 401/402, because the sliding flank 50* of scanning part 28 under the pressure force of spring 55 initially runs into the depression and then as a result of the sliding pin 50 running on to control cam 61 on the other side of the link, the tie rod part 402 is further forcibly deflected, whilst increasing the size of air gap 40. Following a roughly 45° rotation in the same direction, due to the action of retaining spring 55 sliding flank 50* is blocked against further movement on one of the retaining edges 63. The now-performed ⅛ turn is not sufficient for operating the lock. In addition, a clearly defined blocking or retaining position of probe 28 is brought about by the constantly acting pressure force of the retaining spring. If this security action fails, e.g. in the case of a fracture of the retaining spring, in the case of an attempted opening turn without a magnetic pulling action, the probe 28 is moved into a clearly defined blocking position by means of guide cams 61 and in this position sliding flank 50* strikes against the retaining flank 63. The effect of the retaining spring is an additional security measure, in order to assist a blocking action in the normal case.

FIG. 4 shows the development of the presently discussed control link with which the scanning part 28 can be brought into particular positions. The web-like construction of the link, which is advantageous from the manufacturing standpoint, can be clearly seen in FIG. 4C. The control web of sliding link 60 is constructed in such a way that it maintains the scanning part in the open or closed position over most of its length. The control web also has further control elements in the form of cams 61 and depressions with flanks 62 and 63 enabling open/closed functions and authorization restrictions to be carried out in conjunction with exciting pulses. FIG. 4A shows the link with two depressions symmetrically arranged in mirror image relative to the zero position and their blocking edges 63 and entry edges 62 seen in the direction of arrows A. FIG. 4B shows the control link with the two blocking or control cams 61 seen in the direction of arrow B. In both cases a fixing pin 65 is shown enabling the control part 60 constructed as a link ring to be fixed in rotation-restrained manner on the mechanical closing part such as the rotor/stator.

Finally, FIG. 4C shows half in cross-section and half in elevation the link ring from direction C, in such a way that all the control elements can be simultaneously seen, namely the web of sliding link 60, the blocking or control cam 61, entry edge 62 and blocking edge 63.

Figure 5C:
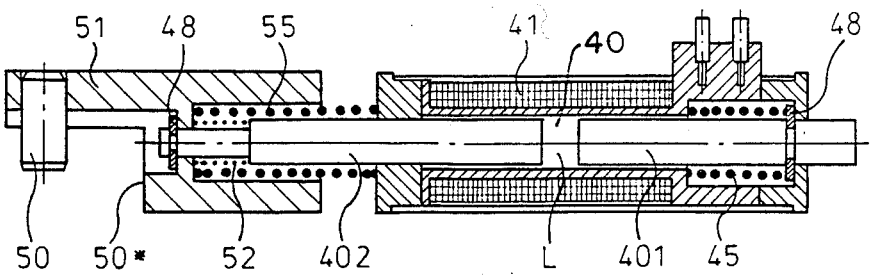
FIGS. 5A, 5B and 5C are schematic side elevations of the locking means according to the invention in three operating states.
Figure 5B:
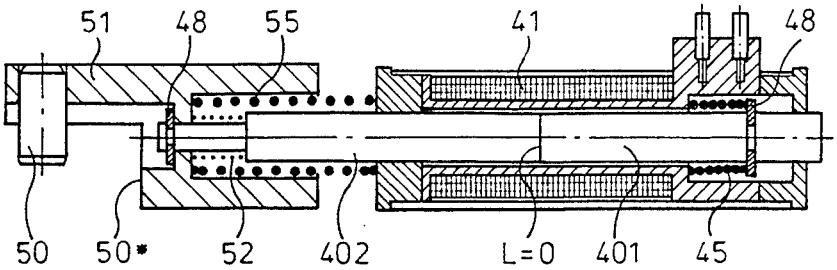
Figure 5A:
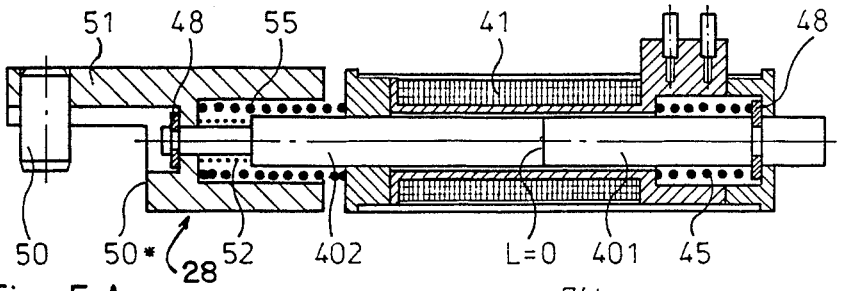

FIGS. 5A, 5B and 5C show three operating cases. These constitute the normal or basic position (FIG. 5A) with an air gap equal to zero and the probe 28 under the tension of the retaining spring 55 (optionally also under the action of the tolerance compensating spring 45). This position e.g. corresponds to the 0° position. As a result of the magnetically negligible residual air gap of the compressed tie rod parts 401/402, only a small initial capacity is required for exciting the magnetic circuit and this can correspond to the desired, following, minimum retaining or holding capacity.

If the guide cam 61 slides past probe 28 with the coil energized and the tie rod parts connected, the complete tie rod 401/402 is drawn out of the coil, counter to the action of return spring 45 (FIG. 5B), in order to pass said security member at 30 angular degrees. After passing guide cam 61, the same return spring 45 draws back the probe until the sliding flank 50* does not strike the blocking flange 63 and this is then a correct opening or closing rotation.

In the case of a non-energized coil, the sliding flank 50* of probe 28 passes along the guide cam 61 (additionally supported by retaining spring 55) and along flank 62 into the link depression, so that through the tension of the return spring and the retaining spring, the two tie rod parts 401/402 separate and an air gap L is formed. This air gap is increased in size on passing guide cam 61 (FIG. 5C 30 angular degrees as in FIG. 5B) and on further rotation the sliding flank 50* of probe 28 strikes against the blocking flank 63 of the link and rotation is prevented. Due to the low voltage and the air gap even an exciting pulse occurring at this time could not permit this incorrect opening or closing rotation. Only after resetting to the normal position can a correct function be initiated again, i.e. only when the air gap is equal to zero condition is restored. Then the exciting voltage applied is again sufficient to bring about magnetic flux.

In operation, the tensions of retaining spring 55 and return spring 45 act against one another. The following measure was then taken to provide clearly defined conditions here, without making the apparatus more expensive. In order to prevent a possible blocking of rotation in the case of energization, the restoring force of spring 45 must exceed the retaining force of retaining spring 55. So that the same spring can be used for both functions, as a result of a shorter return spring housing the return spring 45 is biased and by making the retaining spring housing longer and disequilibrium of forces is maintained despite corresponding spring excursions. Thus, the same spring type (spring constant+spring geometry) can be used for two different functions. However, the tolerance compensating spring 52 preferably has a higher spring constant than the two other springs. Its clearance is merely intended to prevent the L=0 condition from being disturbed by component tolerances and is not intended to participate in the retaining and return spring functions.

Figure 6A:
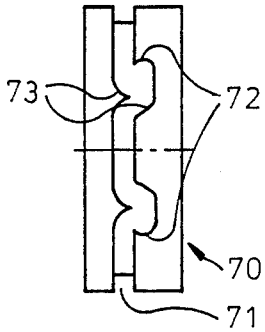
FIGS. 6A and 6B are side elevation and detail views of an additional security means usable in the blocking zone of the apparatus.
Figure 6B:
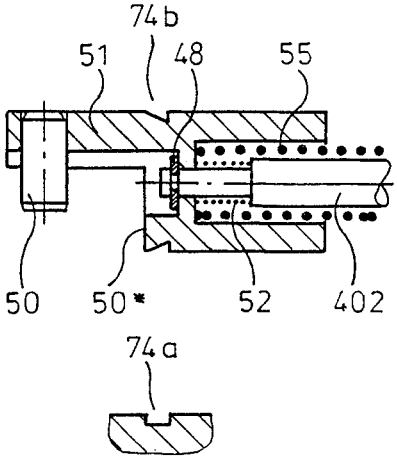

An additional measure for increasing security involves, according to FIGS. 6A and 6B, making the retaining or blocking flank 63 back taper slightly and probe 28 interacting with the blocking flank is provided on body 51 with an annular groove **74*b*. In the case of the control part 70 shown in FIG. 6A, the sliding link 71 has a slot-like configuration, which is naturally also possible in the case of a web-like sliding link. When the probe 28** runs on to the blocking flank, the groove and back taper engage, so that the probe is easily blocked in the axial direction.

In order to increase security, following the blocking 45° angle, it is possible to provide a further guide cam 61 with a compensating depression. In this way it is possible to fulfil the requirement of a specific exciting pulse length, so that the opening or closing process is not impeded. In the case of an unexpected overcoming of the first obstacle, e.g. in the case of a spring fracture, there would still be a further obstacle to prevent incorrect opening or closing.

Thus, a complex closing/opening condition can be superimposed on a lock cylinder. Thus, for operating the lock a flat key with the depressions belonging to the cylinder can be used and which serve solely to release the rotor, or it is possible to use a key equipped with electrical means which brings about the complex unlocking between stator and housing. The described axial movements of the scanning path and armature are performed manually by means of the key and in a forced manner through an opening turn of the key. The necessary spring tensions, e.g. of spring 45 for initiating rotation are brought about by means of manual force, so that the said electromagnetic locking means can be operated in an extremely power-saving manner. This means that a very large amount of power is supplied by operating the key. In order to give the key a familiar appearance, in the case of electronically controlled lock operation, the key shank preferably has milled in rows of depressions with a "false" code, which does not release the rotor/stator barrier.

The aforementioned prior art shows how the electromagnetic locking apparatus according to the invention is arranged on a lock cylinder.

We claim:

1. Locking means for a lock of the type having a lock cylinder with a rotor, a driver mounted on one end of the rotor and restrained against rotation relative to the rotor, a stator substantially surrounding the rotor, electromagnetic locking means mounted adjacent the lock cylinder and a control part having a shaped control surface mounted on a rotatable part of the lock and engageable with the locking means to control unlocking of that rotatable part, wherein the locking means comprises an energizable electromagnet coil, a tie rod having first and second coaxial, axially movable parts movable between abutting and spaced positions, said first part being axially movable in a first direction by said electromagnet coil and said parts being axially movable together when an energizing signal is provided when said parts are abutting;

a return spring urging said first part in a direction counter to said first direction; and a probe fixedly attached to an end of said second tie rod part and engaging said control surface of said control part, said probe preventing rotation of said control part relative to said probe in the absence of an energizing signal provided when said tie rod parts are in an abutting relationship.

2. Locking means according to claim 1 wherein said probe includes a probe body having a sliding pin and a sliding flank in spaced relationship with said pin, said probe body being slidably mounted on said second tie rod part; and a tolerance compensating spring urging said body toward an extended position on said second tie rod part.

3. Locking means according to claim 2 wherein said control part comprises an annular link and said control surface comprises a cam surface for cooperating with said sliding pin and flank including a central neutral portion, sloping surfaces on either side of said neutral portion and step walls beyond said sloping surfaces for engaging at least one of said pin and flank.

4. Locking means according to claim 3 and further including a retaining spring for positioning said probe relative to said control part.

5. Locking means according to claim 4 wherein said retaining spring acts counter to said return spring and is arranged to supply lower spring force than said return spring.

6. Locking means according to claim 5 wherein said retaining spring has the same geometry and spring constant as said return spring and wherein said return spring is prebiased to supply higher spring force than said retaining spring.

7. Locking means according to claim 3 wherein said stop walls have reverse tapers relative to said sloping surfaces for positive blocking of one of said pin and flank.

* * * * *